US010498031B2

(12) United States Patent
Gu

(10) Patent No.: US 10,498,031 B2
(45) Date of Patent: Dec. 3, 2019

(54) ANTENNA SYSTEM AND MOBILE TERMINAL

(71) Applicant: AAC Technologies Pte. Ltd., Singapore (SG)

(72) Inventor: Haichuan Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 14 days.

(21) Appl. No.: 16/057,947

(22) Filed: Aug. 8, 2018

(65) Prior Publication Data

US 2019/0207310 A1 Jul. 4, 2019

(30) Foreign Application Priority Data

Dec. 29, 2017 (CN) ..... 2017 1 1478842

(51) Int. Cl.

| | |
|---|---|
| ***H01Q 1/24*** | (2006.01) |
| ***H01Q 5/335*** | (2015.01) |
| ***H01Q 13/16*** | (2006.01) |
| ***H01Q 1/22*** | (2006.01) |

(52) U.S. Cl.
CPC ..... *H01Q 5/335* (2015.01); *H01Q 1/2291* (2013.01); *H01Q 1/243* (2013.01); *H01Q 13/16* (2013.01)

(58) Field of Classification Search
CPC ..... H01Q 5/335; H01Q 1/243; H01Q 1/2291; H01Q 13/16
See application file for complete search history.

(56) References Cited

U.S. PATENT DOCUMENTS

| | | | | |
|---|---|---|---|---|
| 2011/0254741 | A1* | 10/2011 | Ishimiya | H01Q 1/243 343/702 |
| 2016/0365623 | A1* | 12/2016 | Kim | H01Q 1/243 |
| 2017/0012341 | A1* | 1/2017 | Mai | H01Q 1/243 |
| 2017/0331189 | A1* | 11/2017 | Wang | H01Q 9/04 |

* cited by examiner

*Primary Examiner* — Hoang V Nguyen
(74) *Attorney, Agent, or Firm* — IPro, PLLC; Na Xu

(57) ABSTRACT

The antenna system includes: an upper frame, including a feeding point, a ground point, and a connection ground, wherein the ground point is arranged between the feeding point and the connection ground; system ground; feed source; matching network, including a first-order band elimination filter and a first capacitor that are connected in series; and first inductor. The upper frame is disposed at one side periphery of the system ground, and a clearance region is formed between the system ground and the upper frame. The feed source is connected to the feeding point through the matching network, the ground point is connected to the system ground through the first inductor, and the connection ground is connected to the system ground, so as to form a GPS antenna, a WIFI 2.4G antenna and a WIFI 5G antenna.

18 Claims, 6 Drawing Sheets

ANTENNA SYSTEM AND MOBILE TERMINAL

CROSS-REFERENCE TO RELATED APPLICATIONS

The present application claims priority to Chinese Patent Application No. 201711478842.8, filed on Dec. 29, 2017, the content of which is incorporated herein by reference in its entirety.

TECHNICAL FIELD

The present disclosure relates to the field of communication technologies and, in particular, to an antenna system and a mobile terminal.

BACKGROUND

In the field of communication technologies, multiband is always a development tendency for mobile communication. A mobile terminal in the prior art such as an antenna system of a mobile phone includes a rear shell and a frame, and a clearance region is defined between the rear shell and the frame. Due to the influence of the volume of the mobile terminal, the clearance region is small. Besides, for a metal frame antenna structure in the prior art, an upper antenna includes a diversity antenna and an NC antenna, and the diversity antenna occupies most of the metal frame, and thus there is little space left for the radiator of the NC antenna. In other words, the NC antenna should be as short as possible under the premise of guaranteed performance so as to guarantee performance of the diversity antenna. Therefore, the radiator for the NC antenna has a limited length, which makes it difficult to simultaneously cover bands of GPS, WIFI 2.4G, and WIFI 5G, especially WIFI 5G band. However, the application of WIFI 5G will be a development tendency in the field of communication technologies. Therefore, it is necessary to provide an antenna system as soon as possible which can cover GPS, WIFI 2.4G, and WIFI 5G at the same time.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

REFERENCE SINGS

Figure 1:
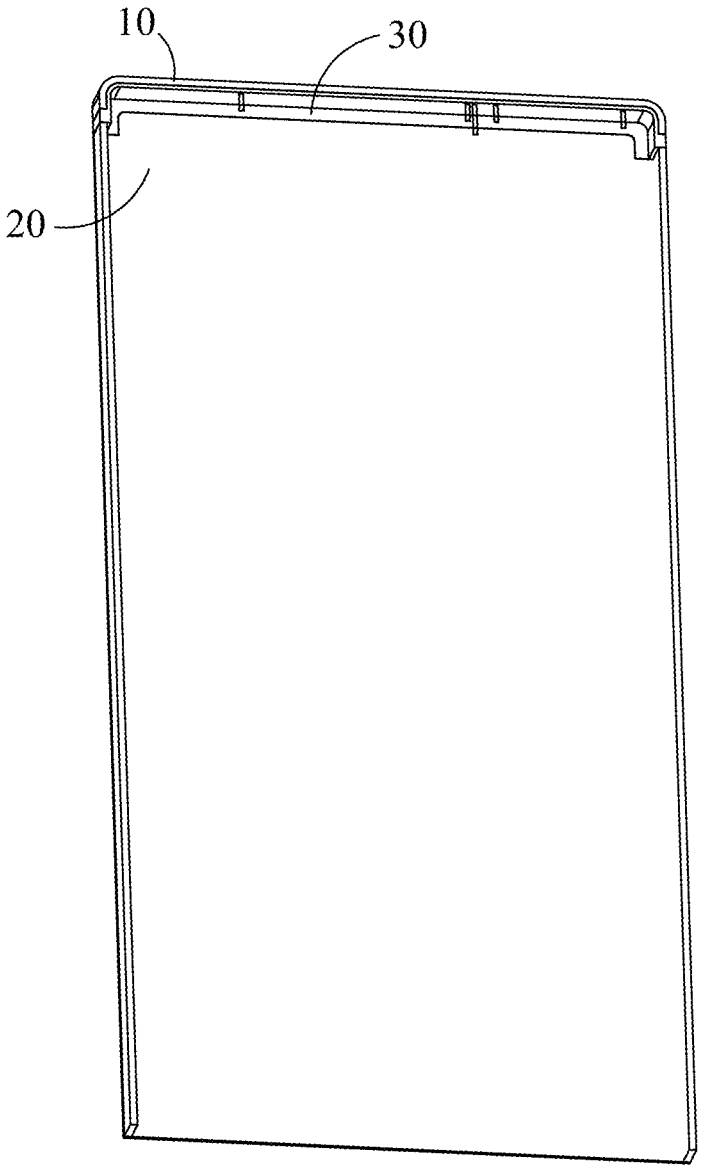
FIG. 1 is a structural schematic diagram of an antenna system provided by an embodiment of the present disclosure.

10—upper frame;
11—feeding point;
12—ground point;
13—connection ground;
14—first end;
15—second end;
20—system ground;
30—clearance region;
31—U—shaped slot;
32—first side slot;
33—second side slot;
40—matching network;
41—first-order band elimination filter;
411—second inductor;
412—second capacitor;
42—fourth inductor;
43—first capacitor;
44—third inductor;
50—first inductor;
60—feed source.

The drawings herein are incorporated into and constitute a part of the specification, which show the embodiments of the present disclosure and illustrate the principles of the present disclosure together with the specification.

DESCRIPTION OF EMBODIMENTS

The present disclosure will be further described in detail in the following through specific embodiments and with reference to the accompanying drawings.

As shown in FIG. 1-4, the present disclosure provides an antenna system that can be applied to a mobile terminal such as a mobile phone. The antenna system includes an upper frame 10, a system ground 20, a feed source 60, a matching network 40, and a first inductor 50. The upper frame 10 includes a feeding point 11, a ground point 12, and a connection ground 13. The ground point 12 is disposed between the feeding point 11 and the connection ground 13. The matching network 40 includes a first-order band elimination filter 41 and a first capacitor 43 which are connected in series. The upper frame 10 is disposed at one side periphery of the system ground 20. A clearance region 30 is formed between the system ground 20 and the upper frame 10. The feed source 60 is connected to the feeding point 11 through the matching network 40. The ground point 12 is connected to the system ground 20 through the first inductor 50. The connection ground 13 is connected to the system ground 20. In this manner, a GPS antenna, WIFI 2.4G antenna, and WIFI 5G antenna are formed.

For the above-mentioned antenna system, a first-order band elimination filter 41 and a first inductor 43 are provided. When the frequency of the first-order band elimination filter 41 is higher than the center frequency, it is capacitive; when the frequency of the first-order band elimination filter 41 is lower than the center frequency, it is inductive. Therefore, by adjusting the frequency of the first-order band elimination filter 41, the antenna system can simultaneously cover GPS antenna, WIFI 2.4G antenna, and WIFI 5G antenna. Besides, by providing the first inductor 43, a high mode of the WIFI 5G antenna can be adjusted, which makes it possible to cover all bands of WIFI 5G.

Figure 2:
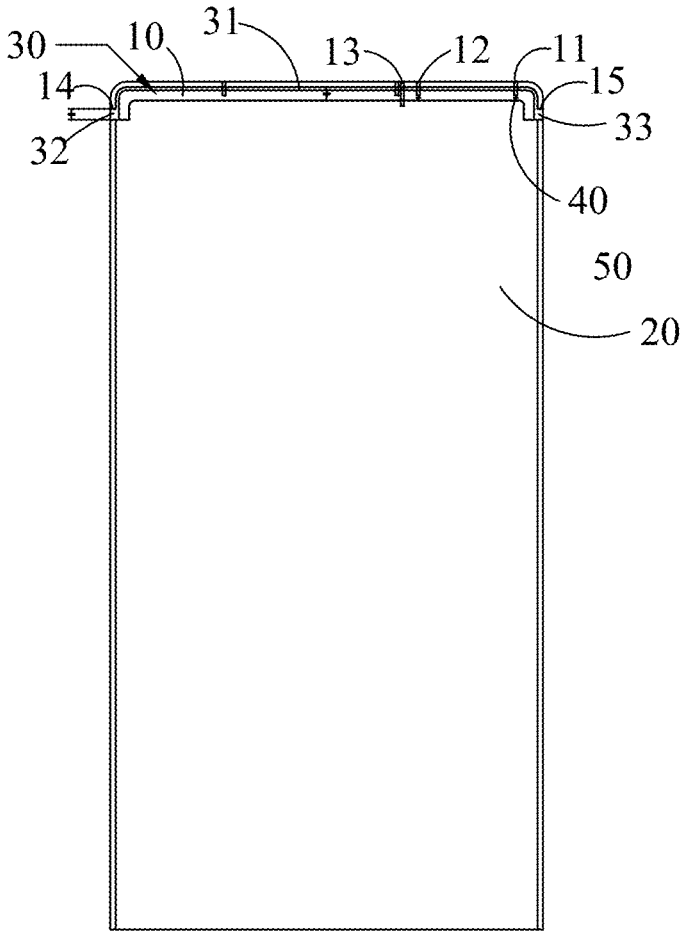
FIG. 2 is a front view of an antenna system provided by an embodiment of the present disclosure.

It should be understood that the antenna system further includes a printed circuit board (Printed Circuit Board, PCB), and the above-mentioned feed source 60 is disposed on the PCB. In addition, the antenna system may further include a frame surrounding the periphery of system ground 20. Two sides of the frame, which are opposite to each other, are respectively provided with breaks to form an upper frame 10 at the top of the frame. The frame may be a rectangular frame, and the upper frame 10 occupies at least one short side of the rectangular frame. The upper frame 10 includes a first end 14 close to the ground point 12 and a second end 15 close to the feeding point 11, as shown in FIGS. 2-3, in other words, the first end 14 and the second end 15 are located at the two breaks.

The above-mentioned clearance region 30 includes a U-shaped slot 31, a first side slot 32, and a second side slot 33 which are connected with each other. As shown in FIGS. 2-3, the U-shaped slot 31 is corresponding to the upper frame 10. The first side slot 32 and the second side slot 33 are respectively disposed at two sides of the upper frame 10, in other words, the above-mentioned two breaks form the first side slot 32 and the second side slot 33.

The connection strength of the entire mobile terminal decreases when the U-shaped slot 31 is excessively wide, and the performance of the antenna system decreases when the U-shaped slot 31 is excessively narrow. Therefore, for guaranteeing the strength of the mobile terminal and the performance of the antenna system, the U-shaped slot 31 has a width D1 (as shown in FIG. 3) within a range of 1.5 mm-10 mm, such as 2 mm, 2.5 mm, 6 mm, 8 mm, 9 mm, and 10 mm.

Figure 3:
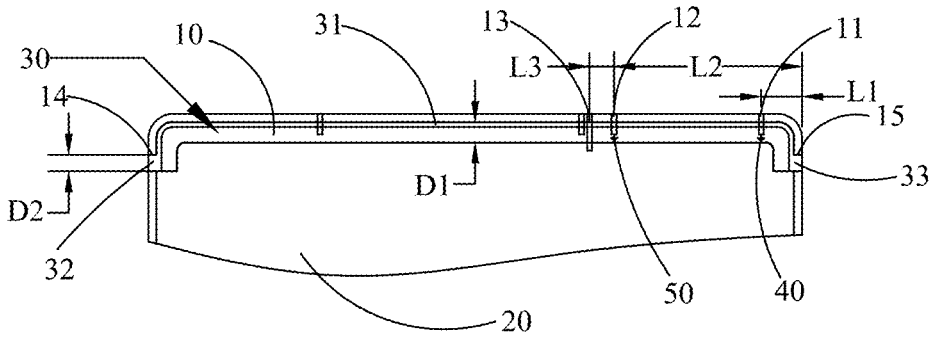
FIG. 3 is a partial view of an antenna system provided by an embodiment of the present disclosure.

Similarly, the first side slot 32 and the second side slot 33 has a width D2 (as shown in FIG. 3) within a range of 1 mm-3 mm, such as 1.5 mm, 2 mm, and 2.5 mm.

Optionally, when the frame is a rectangular frame, the dimension of the frame may be 162 mm×80 mm×5 mm. Along a width direction of the rectangular frame, a minimum distance L1 between the feeding point 11 and the outer edge of the frame is 5 mm, a minimum distance L2 between the ground point 12 and the outer edge of the frame is 23 mm, and a distance L3 between the connection ground 13 and the ground point 12 is 3 mm.

Figure 4:
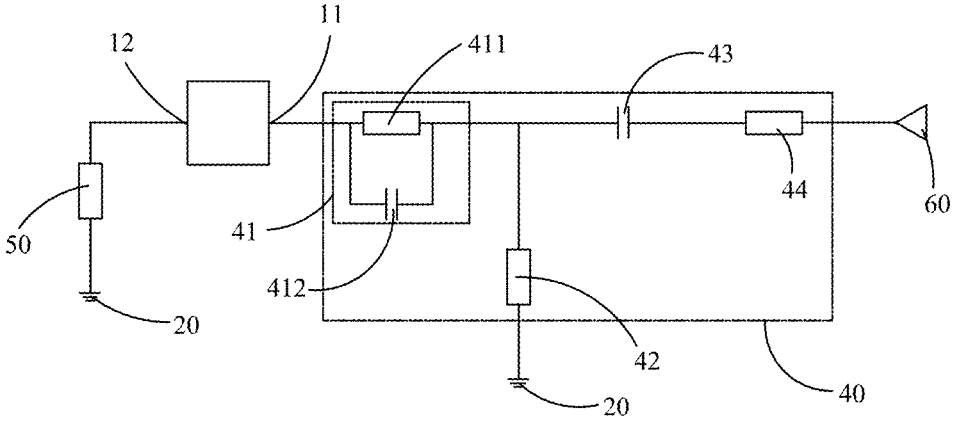
FIG. 4 is an equivalent circuit diagram of an antenna system provided by an embodiment of the present disclosure.

As shown in FIG. 4, the first-order band elimination filter 41 includes a second inductor 411 and a second capacitor 412 which are connected in parallel. In this manner, the closed circuit can present different impedance characteristics at different frequencies so as to achieve that GPS, WIFI 2.4G and WIFI 5G can simultaneously realize impedance matching.

Optionally, the center frequency of the first-order band elimination filter 41 is within a range of 2.4 GHz-5 GHz so as to better form the GPS antenna, the WIFI 2.4G antenna, and the WIFI 5G antenna.

The matching network 40 may further include a third inductor 44, which is connected in series between the first capacitor 43 and the feed source 60. By providing the third inductor 44, the bandwidth of the WIFI 5G antenna can be adjusted to improve the performance of the WIFI 5G antenna.

Further, the matching network 40 further includes a fourth inductor 42. The fourth inductor 42 includes an end connected to the system ground 20, and the other end connected between the first-order band elimination filter 41 and the first capacitor 43. By providing the fourth inductor 42, the resonance position of the GPS antenna can be adjusted, so as to improve the performance of the GPS antenna.

Specifically, the main radiator of the GPS antenna, WIFI 2.4G antenna, and WIFI 5G antenna includes a portion on the upper frame 10 between the connection ground 13 and the second end 15, that is, the resonance frequency of this portion can cover the working frequency of the GPS antenna, WIFI 2.4G antenna, and WIFI 5G antenna.

The working frequency band of the GPS antenna is 1.575 GHz±1.023 GHz. The working frequency band of the WIFI 2.4 antenna is 2.4 GHz-2.5 GHz. The working frequency band of the WIFI 5G antenna is 5.15 GHz-5.85 GHz.

It should be noted that the antenna system includes not only the GPS antenna, WIFI 2.4G antenna, and WIFI 5G antenna, but also a diversity antenna. Optionally, the diversity antenna is also disposed at the upper frame 10, and the main radiator of the diversity antenna may include a portion on the upper frame 10 between the first end 14 and the connection ground 13. That is, in the antenna system of the present disclosure, the diversity antenna and the NC antenna (including the GPS antenna, WIFI 2.4G antenna, and WIFI 5G antenna) can be simultaneously arranged on the upper frame 10, further, the NC antenna is arranged at the right side of the upper frame 10 (illustrated by the view shown in FIG. 3), and the diversity antenna is arranged at the left side of the upper frame 10 (illustrated by the view shown in FIG. 3). By providing the matching network 40 and the first inductor 50, it is achieved that the diversity antenna, GPS antenna, WIFI 2.4G antenna and WIFI 5G antenna can be covered simultaneously with a limited radiation length (i.e., the length of the upper frame 10).

Figure 5:
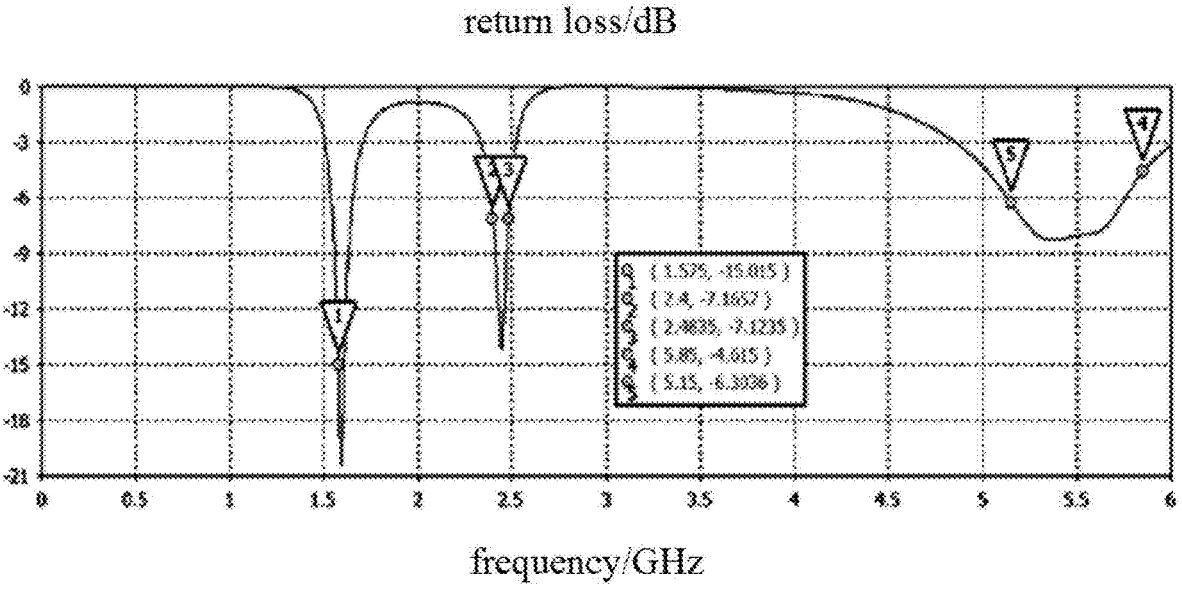
FIG. 5 is a return loss diagram of an antenna system provided by an embodiment of the present disclosure.
Figure 6:
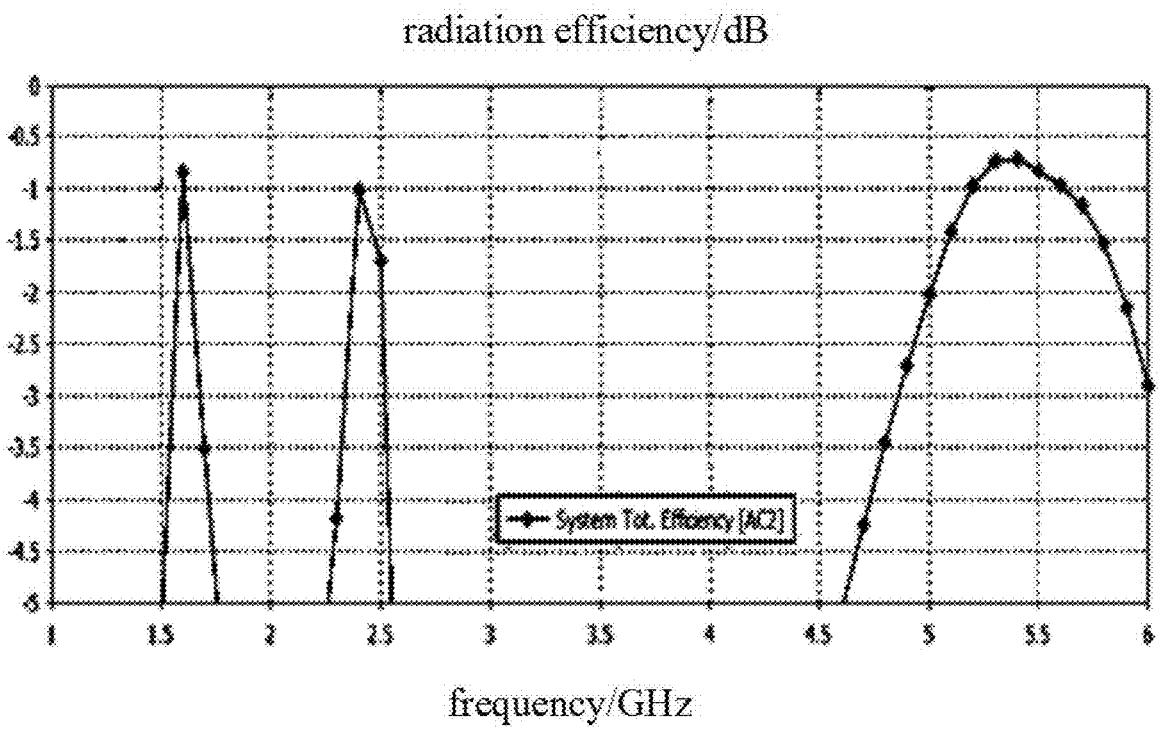
FIG. 6 is a radiation efficiency diagram of an antenna system provided by an embodiment of the present disclosure.

The first inductor 50, the second inductor 411, the third inductor 44, and the fourth inductor 42 may be adjustable inductors or inductors respectively having a fixed value, and the inductance values may be selected according to the requirements of the antenna system. Similarly, the first capacitor 43 and the second capacitor 412 may be adjustable capacitors, and the capacitance values may be selected according to the requirements of the antenna system. In one embodiment, the inductance value of the first inductor 50 is 13n, the inductance value of the second inductor 411 is 5.8n, the inductance value of the third inductor 44 is 3.9n, the inductance value of the fourth inductor 42 is 82n, the capacitance value of the first capacitor 43 is 0.3p, and the capacitance value of the second capacitor 412 is 0.52p. With the matching of the above-mentioned inductance values and capacitance values, the return loss diagram of the antenna system of the present disclosure is shown in FIG. 5, and the radiation efficiency diagram is shown in FIG. 6. It can be seen from FIGS. 5-6 that the GPS antenna, WIFI 2.4G antenna and WIFI 5G antenna have a good performance.

In addition, the present disclosure further provides a mobile terminal, such as a mobile phone, including the antenna system described in any one of the above-mentioned embodiments.

The above-mentioned descriptions are merely preferred embodiments of the present disclosure and are not intended to limit the present disclosure. For those skilled in the art, the present disclosure may have various changes and modifications. Any modifications, equivalent substitutions, and improvements made within the spirit and principle of the present disclosure shall be included in the protection scope of the present disclosure.

What is claimed is:

1. An antenna system, include:

an upper frame, the upper frame comprising a feeding point, a ground point, and a connection ground, wherein the ground point is arranged between the feeding point and the connection ground;

a system ground;

a feed source;

a matching network, the matching network comprising a first-order band elimination filter and a first capacitor that are connected in series; and a first inductor, wherein the upper frame is disposed at a periphery of one side of the system ground, and a clearance region is formed between the system ground and the upper frame, and wherein the feed source is connected to the feeding point through the matching network, the ground point is connected to the system ground through the first inductor, and the connection ground is connected to the system ground, so as to form a Global Positioning System (GPS) antenna, a Wireless Fidelity (WIFI) 2.4G antenna and a WIFI 5G antenna.

2. The antenna system according to claim 1, wherein the first-order band elimination filter comprises a second inductor and a second capacitor that are connected in parallel.

3. The antenna system according to any one of claim 2, wherein the clearance region comprises a U-shaped slot, a first side slot, and a second side slot that are connected to each other, the U-shaped slot is disposed opposite the upper frame, and the first side slot and the second side slot are respectively disposed at two ends of the upper frame.

4. A mobile terminal, comprising the antenna system according to claim 2.

5. The antenna system according to claim 1, wherein the matching network further comprises a third inductor, and the third inductor is connected in series between the first capacitor and the feed source.

6. The antenna system according to any one of claim 5, wherein the clearance region comprises a U-shaped slot, a first side slot, and a second side slot that are connected to each other, the U-shaped slot is disposed opposite the upper frame, and the first side slot and the second side slot are respectively disposed at two ends of the upper frame.

7. A mobile terminal, comprising the antenna system according to claim 5.

8. The antenna system according to claim 1, wherein the matching network further comprises a fourth inductor, the fourth inductor comprises an end connected to the system ground and an end connected between the first-order band elimination filter and the first capacitor.

9. The antenna system according to any one of claim 8, wherein the clearance region comprises a U-shaped slot, a first side slot, and a second side slot that are connected to each other, the U-shaped slot is disposed opposite the upper frame, and the first side slot and the second side slot are respectively disposed at two ends of the upper frame.

10. A mobile terminal, comprising the antenna system according to claim 8.

11. The antenna system according to claim 1, wherein the upper frame comprises a first end close to the ground point and a second end close to the feeding point, and wherein each of a main radiator of the GPS antenna, a main radiator of the WIFI 2.4G antenna and a main radiator of the WIFI 5G antenna comprises a portion of the upper frame between the connection ground and the second end.

12. The antenna system according to any one of claim 11, wherein the clearance region comprises a U-shaped slot, a first side slot, and a second side slot that are connected to each other, the U-shaped slot is disposed opposite the upper frame, and the first side slot and the second side slot are respectively disposed at two ends of the upper frame.

13. A mobile terminal, comprising the antenna system according to claim 11.

14. The antenna system according to claim 1, wherein the GPS antenna has a working frequency band of 1.575 GHz±1.023 GHz;

the WIFI 2.4 antenna has a working frequency band of 2.4 GHz-2.5 GHz; and the WIFI 5G antenna has a working frequency band of 5.15 GHz-5.85 GHz.

15. The antenna system according to any one of claim 14, wherein the clearance region comprises a U-shaped slot, a first side slot, and a second side slot that are connected to each other, the U-shaped slot is disposed opposite the upper frame, and the first side slot and the second side slot are respectively disposed at two ends of the upper frame.

16. A mobile terminal, comprising the antenna system according to claim 14.

17. The antenna system according to any one of claim 1, wherein the clearance region comprises a U-shaped slot, a first side slot, and a second side slot that are connected to each other, the U-shaped slot is disposed opposite the upper frame, and the first side slot and the second side slot are respectively disposed at two ends of the upper frame.

18. A mobile terminal, comprising the antenna system according to claim 1.

* * * * *